US009476282B2

(12) United States Patent
Anton et al.

(10) Patent No.: US 9,476,282 B2
(45) Date of Patent: Oct. 25, 2016

(54) METHOD AND APPARATUS FOR SMOOTH BORE TOE VALVE

(71) Applicant: Team Oil Tools, LP, The Woodlands, TX (US)

(72) Inventors: Kenneth J. Anton, Houston, TX (US); Michael J. Harris, Houston, TX (US)

(73) Assignee: TEAM OIL TOOLS, LP, The Woodlands, TX (US)

( * ) Notice: Subject to any disclaimer, the term of this patent is extended or adjusted under 35 U.S.C. 154(b) by 672 days.

(21) Appl. No.: 13/924,828

(22) Filed: Jun. 24, 2013

(65) Prior Publication Data

US 2014/0374096 A1 Dec. 25, 2014

(51) Int. Cl.

| | |
|---|---|
| ***E21B 34/10*** | (2006.01) |
| ***E21B 34/06*** | (2006.01) |
| *E21B 34/00* | (2006.01) |

(52) U.S. Cl.

CPC ..... *E21B 34/10* (2013.01); *E21B 34/063* (2013.01); *E21B 34/102* (2013.01); *E21B 34/108* (2013.01); *E21B 2034/007* (2013.01)

(58) Field of Classification Search

CPC .... E21B 34/063; E21B 34/10; E21B 34/102; E21B 34/108; E21B 2034/007

See application file for complete search history.

(56) References Cited

U.S. PATENT DOCUMENTS

| | | | |
|---|---|---|---|
| 2,251,977 | A | 8/1941 | Burt |
| 4,515,217 | A | 5/1985 | Stout |
| 4,609,005 | A | 9/1986 | Upchurch |
| 5,048,611 | A | 9/1991 | Cochran |
| 5,261,486 | A | 11/1993 | Cornette |
| 6,286,594 | B1 | 9/2001 | French |
| 6,293,342 | B1 | 9/2001 | McGarian |
| 6,464,008 | B1 | 10/2002 | Roddy |
| 7,032,675 | B2 | 4/2006 | Steele et al. |
| 7,055,598 | B2 | 6/2006 | Ross |
| 7,237,611 | B2 | 7/2007 | Vincent et al. |
| 7,866,402 | B2 | 1/2011 | Williamson, Jr. |
| 7,909,095 | B2 | 3/2011 | Richards et al. |
| 7,926,573 | B2 | 4/2011 | Swan et al. |

(Continued)

FOREIGN PATENT DOCUMENTS

| | | | |
|---|---|---|---|
| WO | 2008091345 A1 | 7/2008 | |
| WO | WO 2009132462 A1 * | 11/2009 | ..... E21B 23/006 |

OTHER PUBLICATIONS

International Search Report and Written Opinion dated Dec. 9, 2014 from International Application No. PCT/US2014/052579; pp. 1-16.

*Primary Examiner* — Jennifer H Gay
*Assistant Examiner* — George Gray
(74) *Attorney, Agent, or Firm* — MH2 Technology Law Group, LLP

(57) ABSTRACT

A smooth bore toe valve includes a first sub defining a through bore and a fluid flow path through a wall thereof; a second sub; a housing mechanically engaged with the first and second subs to define a valve cavity axially between the first and second subs and to define a chamber radially between the first and second subs and the housing, the housing further defining a plurality of openings in a wall thereof; and a sleeve disposed within the chamber between the housing and the first and second subs to close the openings and, upon application of fluid pressure horn the through bore through the fluid this path, open the openings to fluid flow from the valve cavity to the exterior of the housing. A method for using such a valve is also disclosed.

26 Claims, 5 Drawing Sheets

(56) References Cited

U.S. PATENT DOCUMENTS

| | | | | |
|---|---|---|---|---|
| 8,096,363 | B2 | 1/2012 | Williamson, Jr. | |
| 8,267,178 | B1 | 9/2012 | Sommers et al. | |
| 8,555,960 | B2 | 10/2013 | Mailand et al. | |
| 8,695,716 | B2 | 4/2014 | Ravensbergen | |
| 8,757,265 | B1 | 6/2014 | Cuffe et al. | |
| 2002/0121373 | A1 | 9/2002 | Patel | |
| 2002/0166665 | A1 | 11/2002 | Vincent et al. | |
| 2003/0056951 | A1 | 3/2003 | Kaszuba | |
| 2003/0209349 | A1 | 11/2003 | Taylor et al. | |
| 2005/0072575 | A1 | 4/2005 | Yeo | |
| 2007/0062690 | A1* | 3/2007 | Witcher | E21B 33/12 166/222 |
| 2007/0272411 | A1 | 11/2007 | Lopez de Cardenas | |
| 2008/0302538 | A1 | 12/2008 | Hofman | |
| 2009/0044944 | A1 | 2/2009 | Murray et al. | |
| 2009/0095463 | A1 | 4/2009 | Swan et al. | |
| 2009/0095486 | A1 | 4/2009 | Williamson, Jr. | |
| 2010/0314562 | A1 | 12/2010 | Bisset | |
| 2011/0174491 | A1 | 7/2011 | Ravensbergen et al. | |
| 2012/0111574 | A1 | 5/2012 | Desranleau et al. | |
| 2012/0279723 | A1 | 11/2012 | Hofman et al. | |
| 2013/0056206 | A1* | 3/2013 | Jackson | E21B 34/102 166/281 |
| 2014/0076578 | A1 | 3/2014 | Hofman et al. | |
| 2014/0116721 | A1 | 5/2014 | Hofman et al. | |
| 2014/0251636 | A1 | 9/2014 | Hofman et al. | |

* cited by examiner

METHOD AND APPARATUS FOR SMOOTH BORE TOE VALVE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This section of this document introduces information from the art that may be related to or provide context for some aspects of the technique described herein and/or claimed below. It provides background information to facilitate a better understanding of that which is disclosed herein. This is a discussion of "related" art. That such art is related m no way implies that it is also "prior" art. The related art may or may not be prior art. The discussion in this section is to be read in this light, and not as admissions of prior art.

It is well known that hydrocarbon products such as oil and natural gas are generally extracted from wells drilled into the earth. One aspect of drilling such wells is known as "completion". Completion is the process of preparing an already drilled well for production (or, in some cases, injection). Completions frequently include cementing operations in which cement is pumped through the well bore to for example, cement casing to the well but Cementing operations typically also include "wiping" the well bore. To wipe the well bore, a wiper device such as a wiper plug, dart, or ball is pumped down the string through which the cement is pumped. (Wiper devices can lead the cement, follow the cement or both.) The wiper device is designed as a barrier to prevent cement contamination with displacement or wellbore fluids as well as to "wipe" excess or superfluous cement from the string.

After cementation the well bore must be re-opened down hole to allow circulation of fluids necessary to finish the completion process. This is done with what is known as a "toe valve" or an "initiation valve", although other methods include perforating or creating a "wet shoe" during cementation. However, sometimes the toe valve does not initiate and blocks the needed circulation. One factor that plays a role in these failures is cement left behind in the toe valve that the cement wiper plug was unable to remove.

The presently disclosed technique is directed to resolving, or at least reducing, one or all of the problems mentioned above. Even if solutions are available to the art to address these issues, the art is always receptive to improvements or alternative means, methods and configurations. Thus, there exists and need for technique such as that disclosed herein.

SUMMARY

In a first aspect, a smooth bore toe valve includes a first sub defining a through bore and a fluid flow path through a wall thereof; a second sub; a housing mechanically engaged with the first and second subs to define a valve cavity axially between the first and second subs and to define a chamber radially between the first and second subs and the housing, the housing further defining a plurality of openings in a wall thereof; and a sleeve disposed within the chamber between the housing and the first and second subs to close the openings and, upon application of fluid pressure from the through bore through the fluid flow path, open the openings to fluid flow from the valve cavity to the exterior of the housing.

In a second aspect, a method for opening a toe valve, comprising begins by creating a fluid pressure in a toe valve in a well bore. The toe valve comprises: a first sub defining a through bore and a fluid flow path through a wall thereof; a second sub defining a second recess in the outer diameter of one end thereof; a housing mechanically engaged with the first and second subs to define a valve cavity between the first and second subs and a chamber, the housing further defining a plurality of openings between the valve cavity and the exterior of the housing; and a sleeve disposed within the chamber between the housing and the first and second subs to close the openings and, upon application of fluid pressure from the through bore through the fluid flow path, open the openings. Once the fluid pressure is created, the method then produces a differential pressure across the sleeve to move it from a position in which the openings are closed and a position in which the openings are open.

In a third aspect, a method of actuating a toe valve, the method comprising: creating a fluid pressure in the toe valve to create a pressure differential across a sleeve disposed in the toe valve, wherein the sleeve is disposed between a first sub, a second sub, and a housing; rupturing a pressure barrier of the toe valve; sliding a sleeve of the toe valve from a closed position to an open position; and flowing the fluid through a valve cavity between the first and second subs into a well.

The above paragraphs present a simplified summary of the presently disclosed subject matter in order to provide a basic understanding of some aspects thereof. The summary is not an exhaustive overview, nor is it intended to identify key or critical elements to delineate the scope of the subject matter claimed below. Its sole purpose is to present some concepts in a simplified form as a prelude to the more detailed description set forth below.

BRIEF DESCRIPTION OF THE DRAWINGS

The invention may be understood by reference to the following description taken in conjunction with the accompanying drawings, in which like reference numerals identify like elements, and in which:

FIGS. 4A-48 details the locking mechanism of the toe valve embodiment of FIGS. 2A-2C.

FIG. 5 is an exploded view of the embodiment of FIGS. 2A-2C.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the subject matter claimed below will now be disclosed. In the interest of clarity, not all features of an actual implementation are described in this specification. It will be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 1:
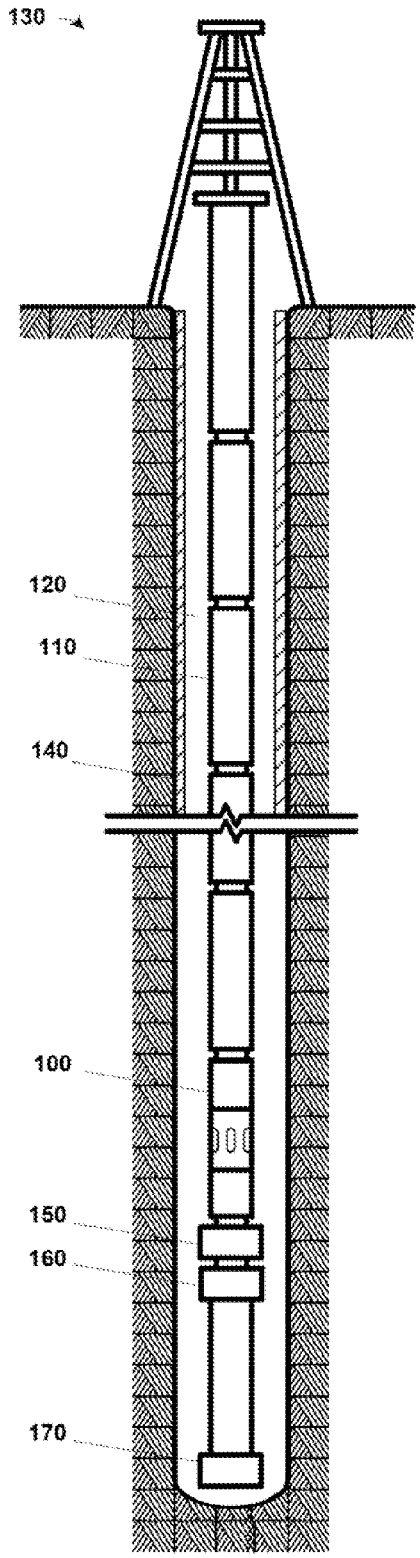
FIG. 1 conceptually depicts a tubular string, deployed for cementing operations.

Turning, now to FIG. 1, a smooth bore toe valve 100 is shown deployed as a part of a tubular string 110 in a well bore 120 during a cementing operation 130. The smooth bore valve may be run on a liner, a casing, tubing or any other string or pressure bearing pipe lowered into the well depending on the embodiment. Furthermore, although this particular embodiment is intended for a cementing operation, the presently disclosed invention can be used in un-cemented applications as well. Examples of such un-cemented applications include, but are not limited to, open hole implementations.

The well bore 120 includes a casing 140 that ends at some predetermined point above the bottom of the well bore 120, and so is an "open hole". The cementing operation 130 may be any kind of cementing operation encountered in the art. Those in the art will appreciate that cementing operations come in many variations depending on numerous factors such as the well bore design, intended operations upon completion, the constitution of the formation in which the well is drilled, and applicable regulations. Accordingly, the embodiments disclosed herein are not limiting and are exemplary only. The technique currently disclosed and claimed is amenable to all manner of operations and variable to meet these types of concerns.

The length and composition of the tubular string 110 will be highly implementation specific and is not material to the practice of the technique. The smooth bore toe valve 100 is disposed in accordance with conventional practice toward the end of the tubular string 110. The smooth bore toe valve 100 may be, for example, three or four joints from the bottom of the casing 140 or the tubular string 110. The joints below the smooth bore toe valve 100 may include but is not limited to a landing collar 150, a float collar 160, a float shoe 170, or some combination of the three depending on the embodiment.

Figure 2A:
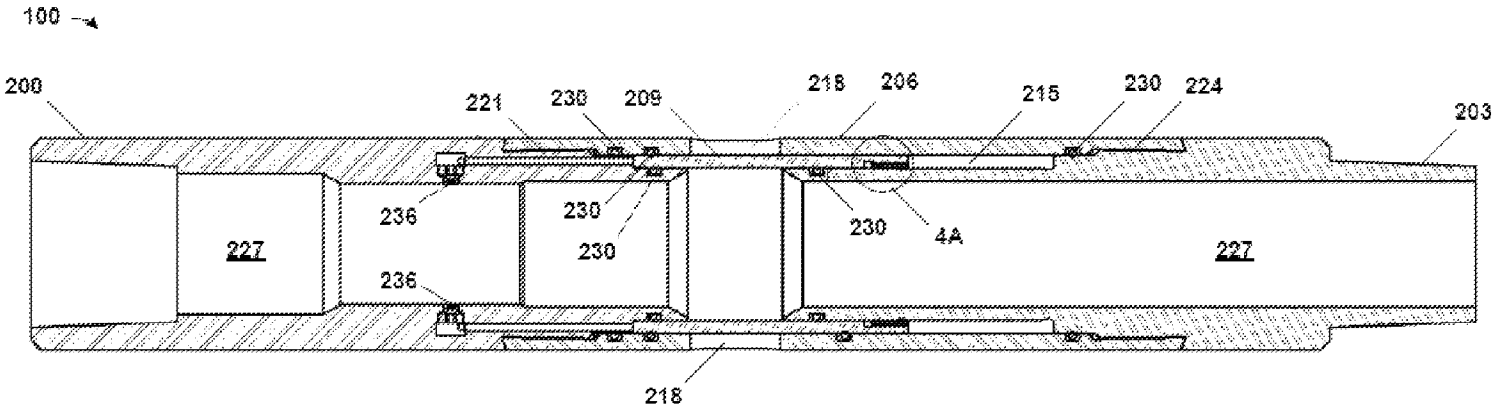
FIGS. 2A- 2C illustrates in sectioned views one particular embodiment of the toe valve first shown in FIG. 1 in closed, partially open, and open positions, respectively.
Figure 2B:
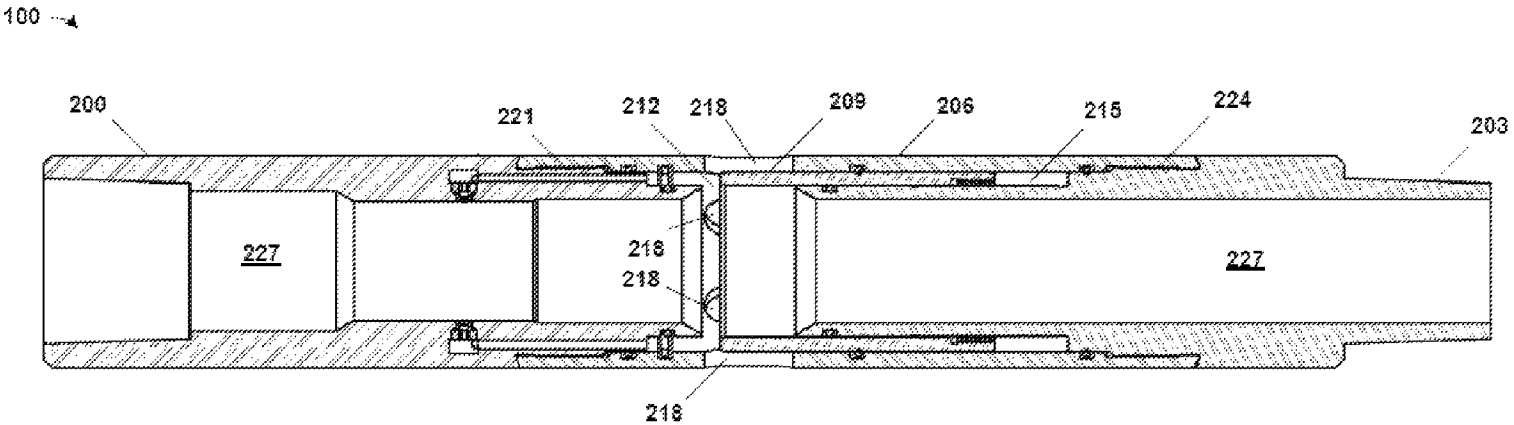
Figure 2C:
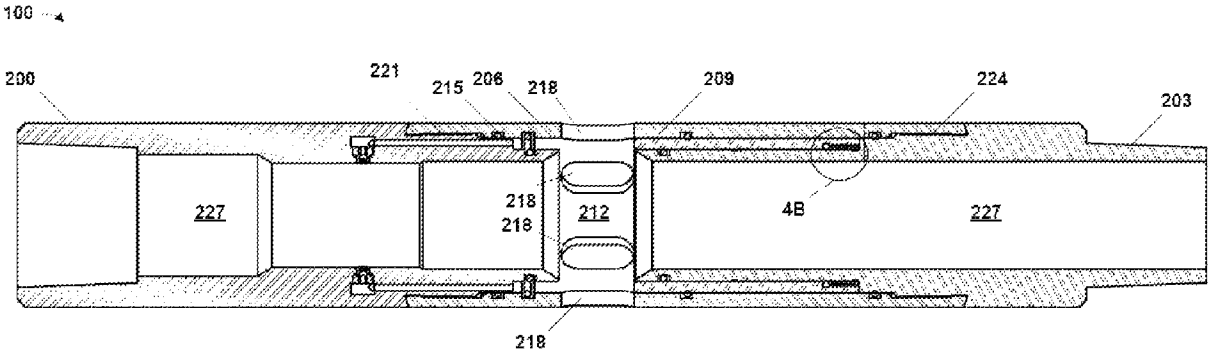
Figure 5:
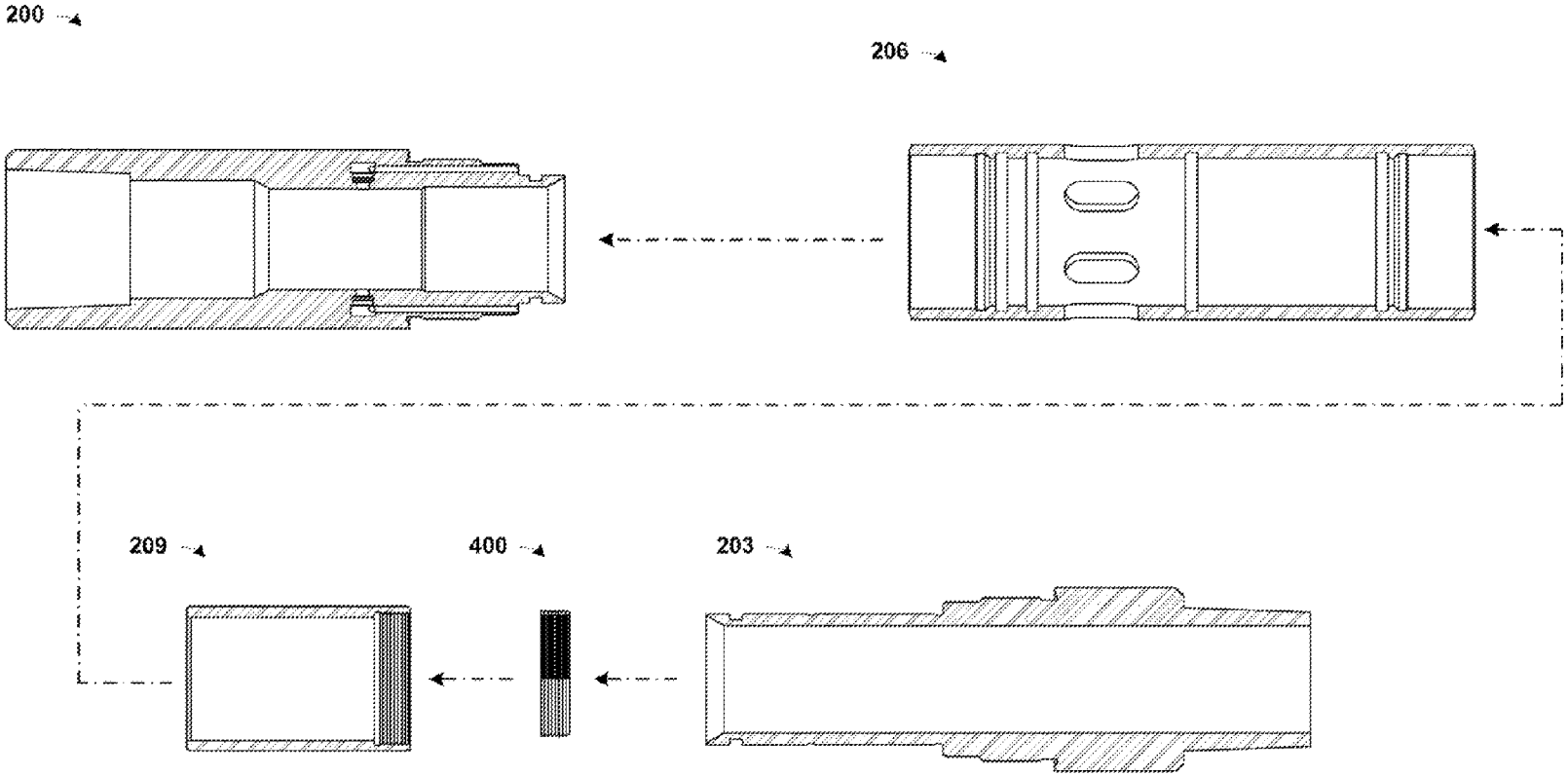

The smooth bore toe valve 100 is shown in better detail in closed, partially open, and open positions in FIGS. 2A-2C. While the smooth bore toe valve 100 is shown assembled in FIGS. 2A-2C, it is shown in an exploded view in FIG. 5. In general, this particular embodiment of the smooth bore toe valve 100 comprises a first sub 200, a second sub 203, a housing 206, and a sleeve 209. The housing 206 mechanically joins the first sub 200 and second sub 203 to define a valve cavity 212, shown best in FIG. 2C, axially between the first and second subs 200, 203 and a chamber 215 radially between the first and second subs 200, 203 and the housing 206. The sleeve 209 translates within the chamber 215 from the closed position shown in FIG. 2A to the open position shown in FIG. 2C. This permits fluid flow through the valve cavity 212 to the exterior of the smooth bore toe valve 100 through the openings 218 in the housing 206 as described more fully below.

Figure 3B:
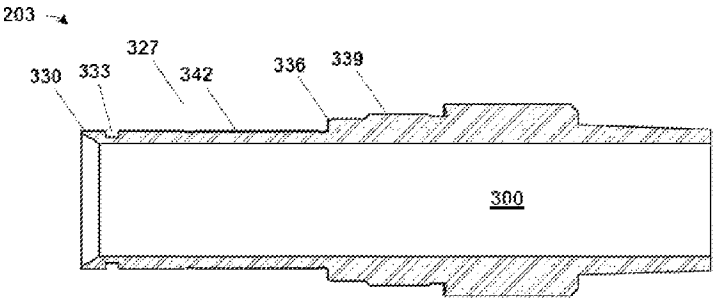
FIGS. 3A-3E illustrates the first sub, second sub, housing, sleeve, and lock ring of the toe valve of FIGS. 2A- 2C.
Figure 3A:
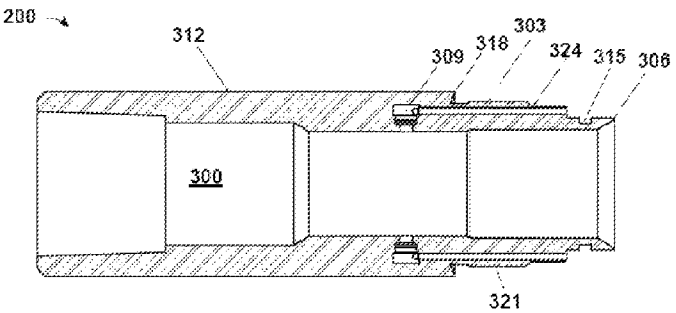

The first sub 200 of the smooth toe bore valve 100 in FIGS. 2A-2C is better shown in FIG. 3A. In this particular embodiment, the first sub 200 defines a through bore 300, a first recess 303 in the outer diameter of one end 306 thereof, and a fluid flow path 309 through the wall 312. The first sub 200 also defines another recess 315 in which may be disposed a sealing element, such as an elastomeric O-ring, as described below. The first recess 303 is shown having, in this embodiment, a stepped profile. The step 318 includes a thread 321 that engages a mating thread of the housing 206 to threadably engage the first sub 200 and the housing 206 as shown in FIG. 2A-FIG. 2C. The sleeve 209 translates on the face 324 in operation.

The second sub 203 is shown better in FIG. 313. The second sub 203 defines a continuation of the through bore 300 and a second recess 327 in the outer diameter of one end 330 thereof. It also defines another recess 333 in which may be disposed a sealing element, such as an elastomeric O-ring, as described below. Like the first recess 303, the second recess 327 has a stepped profile. The step 336 includes a thread 339 that engages a mating thread of the housing 206 to threadably engage the second sub 203 and the housing 206 as shown in FIGS. 2A-2C, The sleeve 209 translates on the face 324 and 342 in operation.

Figure 3C:
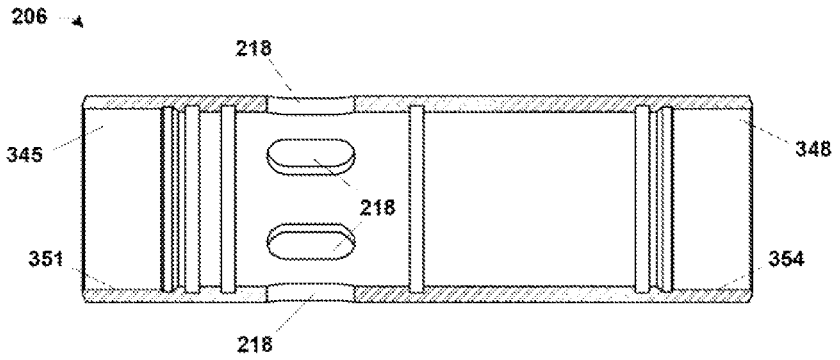

FIG. 3C illustrates the housing 206 of FIGS. 2A-2C. As described above, the housing 206 defines a plurality of openings 218. In the illustrated embodiment, the openings 218 are oval or elliptical in shape. Other embodiments may use alternative geometries for the shape of the openings 218. The geometries of the openings 218 may also vary within a single embodiment if so desired. The openings 218 are disposed radially about the housing 206 as shown, are roughly evenly distributed, and are six (6) in number. Alternative embodiments may use different numbers and distributions. Those in the art will appreciate that the geometry, numbers, and distribution of the openings 218 may affect the efficacy of any given implementation.

The inner diameter of the housing 206 includes a pair of recesses 345, 348 that mate with the recesses 303, 327 of the first and second subs 200, 203. The recesses 345, 348 include threads 351, 354, respectively, that mate with the threads 321, 339 of the recesses 303, 327. Finally, the housing 206 also defines in its inner diameter a plurality of recesses 357 in which sealing elements, such as elastomeric O-rings, may be positioned.

Returning now to FIGS. 2A-2C, the housing 206 threadably engages the first sub 200 and the second sub 203 by the mating of the threads 351, 354 with the threads 321, 339, all shown in FIGS. 3A-3C at the threaded engagements 221, 224. This assembly leaves the first and second subs 200, 203 separated from one another as best shown in FIG. 2C. This separation leaves a gap that, when closed by the housing 206, defines the valve cavity 212.

As mentioned above, the sleeve 209 translates within the chamber 215 from the closed position shown in FIG. 2A to the open position shown in FIG. 2C. The chamber 215 is also defined when the housing 206 threadably engages the first and second subs 200, 203. More particularly, the first and second recesses 303, 327 in the first and second subs 200, 203 in concert span the valve cavity 212 and comprise the first chamber 215.

The sleeve 209 is therefore disposed within the chamber 215 between the housing 206 and the first and second subs 200, 203 to close the openings 218 as best shown in FIG. 2A. Upon application of fluid pressure from the through bore 227 through the fluid flow path 309 (shown in FIG. 3A), the sleeve 209 translates from the closed position of FIG. 2A to the open position shown in FIG. 2C. This translation opens the openings 218 to fluid flow from the valve cavity 212 to the exterior of the housing 206. Note that the embodiment of FIGS. 2A-2C includes a number of sealing elements 230—namely, elastomeric O-rings—to seal the chamber 215 and valve cavity 212 from undesirable fluid flow and to maintain fluid pressures as shown in FIG. 2A.

The illustrated embodiment of the smooth bore toe valve 100 includes a pressure barrier 236 in the fluid flow path 309. In this particular embodiment, the fluid flow path 309 includes an aperture in which the pressure barrier 236 is disposed. There are actually two fluid flow paths 309 in this particular embodiment and each includes a pressure barrier 236. The number of fluid flow paths 309 is not material and may be as low as one and may be more than two. In theory, any number one or greater may be employed although those in the art will recognize that practical considerations will limit the number in any given implementation.

As those in the art will appreciate from the disclosure herein, the pressure barriers 236 allow for a more selective application of fluid pressure through the fluid flow path 309. The pressure barrier 236 may be, for example, a rupture disk, a check valve, or a pressure relief valve, and other embodiments may use still other means for controlling the application of fluid pressure to the sleeve 209. In the illustrated embodiment, the pressure barriers 236 comprise rupture disks. Some embodiments, however, may omit the pressure barriers 236.

Figure 3D:
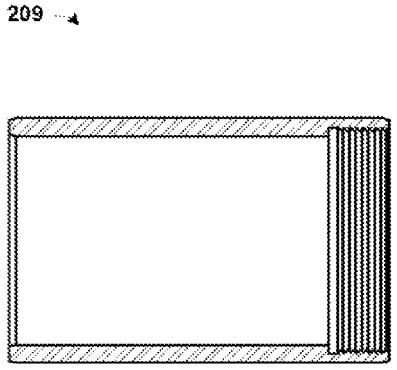
Figure 3E:
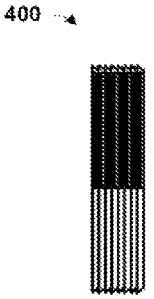
Figure 4A:
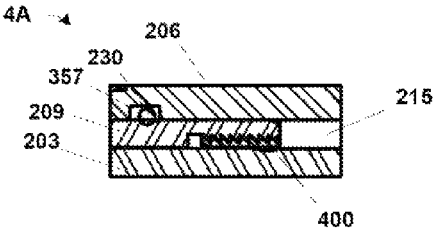
Figure 4B:
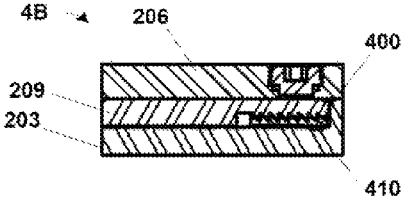

The illustrated embodiment also includes an implementation specific locking mechanism illustrated in FIG. 4A-FIG. 4B. FIG. 4A is an enlargement of element 4A in FIG. 2A and FIG. 4B is an enlargement of element 48 in FIG. 2C, As shown in FIG. 4B 4A, the sleeve 209, also shown in FIG. 3D, includes at the downhole end thereof a body lock ring 400, also shown in FIG. 3E, sometimes also called a ratchet ring. Those in the art having the benefit of this disclosure will appreciate that sonic embodiments may employ the body lock ring 400 on the uphold side of the sleeve 209 to engage uphole of the sleeve 209 rather than downhole.

When the sleeve 209 is in the closed position shown in FIG. 2A, the body lock ring 400 is unengaged in this particular embodiment. (In some embodiments the body lock ring 400 may in fact be engaged at this point to control the translation so that it occurs in only one direction.) When the sleeve 209 translates to the open position shown in FIG. 2C, the body lock ring 400 engages a ratchet thread 410 formed or affixed in the second recess 327 of the second sub 203. This engagement locks the sleeve 209 in the open position. Alternative embodiments may employ other means for locking the sleeve 209 open. Some embodiment may omit this locking feature altogether.

Those in the art having the benefit of this disclosure will appreciate that the present technique admits wide variation in the implementation of the first and second subs 200, 203. There are a wide variety of subs known to the art and any such suitable sub may be used. For example, known types of subs include pup joints, couplings and thread crossovers. Still other types of subs may be used in various alternative embodiments. Furthermore, the first and second subs 200, 203 may be different kinds of subs in some embodiments. The first sub 200 may be, for example, a thread crossover while the second sub 203 may be a pup joint.

In the present drawings, the left hand side of the drawings represents the uphole side of the tool or component relative to the orientation shown in FIG. 1. The right hand side of the drawing therefore represents the downhole side. Thus, in the illustrated embodiments, the first sub 200 is positioned uphole of the second sub 203. Those in the art having the benefit of this disclosure will appreciate that the order could be reversed so that the second sub 203 is uphole of the first sub 200.

Referring again to FIG. 1, the smooth bore toe valve 100 is deployed as part of the tubular string 110 in the wellbore 120. The smooth bore toe valve 100 is closed upon deployment—that is, the sleeve 209 is in the closed position as shown in FIG. 2A. The pressure in the chamber 215 is at atmospheric pressure and is protected by the pressure barrier 236 and the sealing elements 230, all shown in FIG. 2A-FIG. 2C, as described above.

A cementing operation is performed in accordance with conventional practice. The tubular string 110 is then pressured up to produce a differential pressure across the sleeve 209. The differential pressure moves the sleeve 209 from the closed position shown in FIG. 2A in which the openings 218 are closed to the open position shown in FIG. 2C in which the openings 218 are open. More particularly, a fluid is flowed through the toe valve 100 to create a pressure differential across the sleeve 209. In the illustrated embodiment, this ruptures the pressure barrier 236 so that the fluid flows through the fluid flow path 309 to act upon the sleeve 209. This causes the sleeve 209 to slide from the closed position to the open position. Once the toe valve 100 is open, fluid may then flow from the through bore 227 of the tubular string 110 through the valve cavity 212 and the openings 218 into the well bore 120, The fluid used to open the toe valve 100 may be any fluid used in the art in such circumstances. The pressures at which the toe valve 100 opens will be implementation specific depending on operating regulations governing operations on the well. However, pressures on the order of 17,000 psi will not be uncommon. In embodiments employing pressure barriers 236, these types of information will govern the selection of the particular implementation therefore.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A smooth bore toe valve, comprising:

a first sub defining a portion of a through bore and including a fluid flow path through a wall of the first sub;

a second sub defining another portion of the through bore, the second sub being spaced axially apart from the first sub, such that an annular valve cavity is defined axially between the first and second subs and extending from the through bore;

a housing mechanically engaged with the first and second subs, wherein a chamber is at least partially defined radially between the first and second subs and the housing, the housing further defining one or more openings; and a sleeve disposed at least partially within the chamber, the sleeve being movable from a closed position to an open position, wherein, when the sleeve is in the closed position, the sleeve extends across the annular valve cavity, provides an extension of the through bore between the first and second subs, and prevents fluid communication from the through bore to the one or more openings, wherein the one or more openings fluidly communicate with the through bore via the valve cavity when the sleeve is in the open position, and wherein the sleeve is movable in response to an application of fluid pressure from the through bore through the fluid flow path.

2. The smooth bore toe valve of claim 1, wherein the first sub defines a first recess in an outer diameter of one end thereof, the second sub defines a second recess in an outer diameter of one end thereof, and the chamber comprises the first and second recesses when closed by the housing.

3. The smooth bore toe valve of claim 2, wherein the housing is at least partially disposed in the first and second recesses.

4. The smooth bore toe valve of claim 1, wherein the fluid flow path comprises an aperture.

5. The smooth bore toe valve of claim 1, wherein the mechanical engagement between at least one of the first and second subs and the housing is a threaded engagement.

6. The smooth bore toe valve of claim 1, further comprising a pressure barrier disposed in the fluid flow path.

7. The smooth bore toe valve of claim 6, wherein the pressure barrier comprises a rupture disk, a check valve, or a pressure relief valve.

8. The smooth bore toe valve of claim 1, wherein at least one of the first and second subs comprises a coupling, a pupjoint, a thread crossover, or a combination thereof.

9. The smooth bore toe valve of claim 1, wherein the openings comprise an oval geometry.

10. The smooth bore toe valve of claim 1, further comprising a body lock ring, wherein the body lock ring is mechanically engaged with the second sub and the sleeve, to lock the sleeve in the open position.

11. The smooth bore toe valve of claim 1, further comprising means for locking the sleeve in the open position.

12. The smooth bore toe valve of claim 1, wherein the first sub is oriented uphole of the second sub.

13. The smooth bore toe valve of claim 1, wherein the first sub is oriented downhole of the second sub.

14. The smooth bore toe valve of claim 1, wherein the fluid flow path communicates with the through bore and extends at least partially radially outward therefrom.

15. The smooth bore toe valve of claim 1, wherein the first and second subs are only connected together by the housing.

16. The smooth bore toe valve of claim 1, wherein the sleeve in the closed position forms a radially inner-most structure across the valve cavity and defines a portion of the through bore.

17. The smooth bore toe valve of claim 1, wherein a radially-inner, axial end of the first sub is beveled, or a radially-inner, axial end of the second sub is beveled, or both.

18. The smooth bore toe valve of claim 1, wherein the first sub comprises a first recess receiving an end of the housing, a second recess receiving the sleeve when the sleeve is in the closed position, and a shoulder between the first and second recesses that is configured to block the sleeve.

19. The smooth bore toe valve of claim 18, wherein the second sub comprises a first recess receiving another end of the housing, a second recess defining at least a portion of the chamber, and a shoulder configured to block the sleeve.

20. A method for opening a toe valve, comprising:

deploying the toe valve into a well, the toe valve comprising:

a first sub comprising a wall and defining a portion of a through bore and a fluid flow path through the wall;

a second sub defining another portion of the through bore, the second sub being spaced axially apart from the first sub, such that an annular valve cavity is defined axially between the first and second subs and extending from the through bore;

a housing mechanically engaged with the first and second subs, wherein a chamber is at least partially defined between the housing and the second sub, the housing defining one or more openings located between the valve cavity and an exterior of the housing; and a sleeve disposed within the chamber, the sleeve being movable from a closed position to an open position, wherein, when the sleeve is in the closed position, the sleeve extends across the annular valve cavity, provides an extension of the through bore between the first and second subs, and prevents fluid communication from the through bore to the one or more openings via the valve cavity, and wherein, when the sleeve is in the open position, the one or more openings fluidly communicate with the through bore via the valve cavity and with the exterior of the housing, the sleeve being movable in response to an application of fluid pressure from the through bore through the fluid flow path; and producing a differential pressure across the sleeve to move the sleeve from the closed position to the open position.

21. The method of claim 20, wherein producing the differential pressure includes applying a pressure of between about 0 psi and about 20,000 psi to the toe valve.

22. The method of claim 20, further comprising performing a cementing operation before opening the toe valve.

23. A method of actuating a toe valve, the method comprising:

creating a fluid pressure in the toe valve to create a pressure differential across a sleeve of the toe valve, wherein the sleeve is disposed in a chamber defined between a first sub, a second sub, and a housing of the toe valve, and is movable from a closed position where the sleeve blocks fluid flow from a bore of the toe valve to one or more openings defined in the housing, to an open position where the sleeve permits flow through the one or more openings, wherein an annular valve cavity is defined axially between the first sub and the second sub and extends from the bore to the one or more openings, and when the sleeve is in the closed position, the sleeve extends across the annular valve cavity and provides an extension of the bore between the first and second subs, and wherein the fluid pressure ruptures a pressure barrier located in a fluid flow path defined in the first sub of the toe valve such that fluid pressure communicates past the ruptured pressure barrier, through the fluid flow path and to the sleeve, wherein the fluid pressure causes the sleeve to move from the closed position to the open position; and flowing fluid through the bore and a valve cavity between the first and second subs, and into a well.

24. The method of claim 23, wherein the sleeve is configured to translate axially relative to the first sub and the second sub, and inside the housing when moving from the closed position to the open position.

25. The method of claim 23, wherein, when the sleeve is in the closed position, the sleeve is disposed at least partially between the first sub, the second sub, and the housing, and spans the valve cavity, preventing fluid communication from the valve cavity to the one or more openings.

26. The method of claim 23, wherein, when the sleeve is in the open position, the one or more openings provide fluid communication between the valve cavity and the well.

* * * * *